US005484002A

United States Patent [19]

Kupietzky

[11] Patent Number: 5,484,002

[45] Date of Patent: Jan. 16, 1996

[54] DISTRIBUTOR FOR ALCOHOLIC BEVERAGES

[76] Inventor: Michael Kupietzky, 14 Jabotinsky Street, Jerusalem, Israel

[21] Appl. No.: 346,190

[22] Filed: Nov. 22, 1994

[30] Foreign Application Priority Data

Jan. 31, 1994 [IL] Israel ..... 108494

[51] Int. Cl.[6] ..... B65B 3/06

[52] U.S. Cl. ..... 141/237; 222/185.1; 222/571; 239/436; 239/551

[58] Field of Search ..... 222/185, 481, 222/571, 185.1; 141/234, 236, 237, 238, 240, 246; 239/551, 562, 436

[56] References Cited

U.S. PATENT DOCUMENTS

| | | | |
|---|---|---|---|
| 516,065 | 3/1894 | Thomas | 141/246 X |
| 597,912 | 1/1898 | McNerney et al. | 141/234 |
| 2,800,930 | 7/1957 | Recope | 141/238 |
| 2,839,230 | 6/1958 | Pottle | 222/571 |
| 2,872,953 | 4/1959 | Duncan | 141/237 |
| 3,196,909 | 7/1965 | Monk | 141/237 |
| 3,393,716 | 7/1968 | Olson | 141/237 |
| 3,732,903 | 5/1973 | Oates | 141/237 |
| 4,733,680 | 3/1988 | Mosier | 141/234 X |
| 5,092,378 | 3/1992 | Dunham | 141/237 |
| 5,253,807 | 10/1993 | Newbegin | 239/562 X |
| 5,381,839 | 1/1995 | Dowd | 141/237 X |

FOREIGN PATENT DOCUMENTS

| | | | |
|---|---|---|---|
| 263962 | 4/1929 | Italy | 141/237 |
| 136607 | 2/1930 | Switzerland | 141/237 |

*Primary Examiner*—Kevin P. Shaver
*Attorney, Agent, or Firm*—Hoffman, Wasson & Gitler

[57] ABSTRACT

The invention provides a distributor system for wine and other alcoholic beverages, comprising in combination: an elevated distributor bowl for receiving a beverage poured therein, and provided with multiple outlet ports for discharge of said beverage; and a plurality of small drinking cups removably positioned beneath said bowl, to respectively receive a beverage flowing out of said respective outlet ports.

9 Claims, 2 Drawing Sheets

DISTRIBUTOR FOR ALCOHOLIC BEVERAGES

The present invention relates to a beverage distributor for small cups.

More particularly, the invention is concerned with providing means for fast and clean pouring out of wine into a plurality of small drinking cups, as is required for example during the observance of certain religious ceremonies.

At celebrations, parties and other social occasions alcoholic beverages such as wine, brandy, and liqueurs are often served to participants in small cups or glasses. Such drinks are poured out directly from the bottle into a large number of cups, sometimes with uneven results. This task may consume an inordinate amount of the host's time, or if carried out in haste is likely to result in spillage.

Certain religious ceremonies also require distribution of wine to participants. Among Jews, such a ceremony, "Sanctification" or "Kiddush", marks the start of holy days and a further ceremony, "Parting" or "Havdalah" marks the end of such a day. The wine is held in a goblet containing at least 138 milliliters, and at the conclusion of the ceremony the head of the household drinks some of the wine and distributes the remainder to members of his family. As it is often desired that each person drink from his own cup, small cups are provided for this purpose. Here it is to be noted that distribution is often required to be unequal—for example small children, and persons not fond of wine will be given only a small quantity. Again, wine spillage during distribution is common.

Also in certain synagogues the Sanctification and/or Parting ceremonies are performed in public towards the conclusion of prayers. Here the custom is to distribute wine to children only, although the number of small cups to be filled is likely to exceed the number of cups required for this purpose in private residences. Surprisingly, almost no consideration has been given to meeting these requirements. Sets of small silver-plated cups, supported on a suitable matching tray are in common use, but the only provision made in consideration of the likely results of prior-art methods of pouring out wine or other beverages is the provision of a rim around the tray for containment of spillage.

It is therefore one of the objects of the present invention to obviate the disadvantages of the prior-art method of distributing individual quantities of alcoholic beverages and to provide a distributor for achieving this end in a fast and clean manner.

It is a further object of the present invention to provide a distributor complete with a goblet which has value as an ornamental item.

This the present invention achieves by providing a distributor system for wine and other alcoholic beverages, comprising in combination:

- an elevated distributor bowl for receiving a beverage poured therein, and provided with multiple outlet ports for discharge of said beverage; and
- a plurality of small drinking cups removably positioned beneath said bowl, to respectively receive a beverage flowing out of said respective outlet ports.

In preferred embodiments of the present invention, there is provided a distributor system for wine and other alcoholic beverages, comprising in combination: a baseplate; a distributor bowl for receiving a beverage poured therein, and provided with multiple outlet ports for discharge of said beverage; means for supporting said bowl above said baseplate; and a plurality of small drinking cups removably positioned on said baseplate to respectively receive a beverage flowing out of said respective outlet ports.

In especially preferred embodiments of the present invention there is provided such a distributor further comprising a goblet of capacity at least twice that of each of said small drinking cups, said goblet being configured to stand centrally on said distributor bowl when not in use.

Thus in preferred embodiments of the invention, said goblet is provided with a base having a rim being configured to stand centrally on said distributor bowl when not in use.

In a most preferred embodiment of the present invention the distributor is further provided with decorative features whereby the complete distributor may serve for use as an ornament.

The invention will now be described in connection with certain preferred embodiments with reference to the following illustrative figures so that it may be more fully understood.

With specific reference now to the figures in detail, it is stressed that the particulars shown are by way of example and for purposes of illustrative discussion of the preferred embodiments of the present invention only and are presented in the cause of providing what is believed to be the most useful and readily understood description of the principles and conceptual aspects of the invention. In this regard, no attempt is made to show structural details of the invention in more detail than is necessary for a fundamental understanding of the invention, the description taken with the drawings making apparent to those skilled in the art how the several forms of the invention may be embodied in practice.

Figure 1:
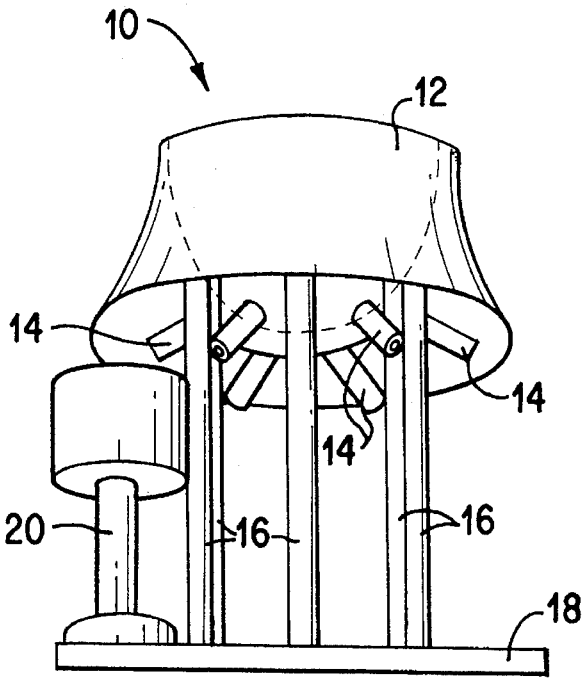
FIG. 1 is a perspective view of a preferred embodiment of the distributor for wine and other alcoholic beverages according to the invention.

There is seen in FIG. 1 a distributor 10 for wine and other alcoholic beverages. In the upper part of the figure there is seen an open distributor bowl 12 for receiving a beverage poured therein. The bowl capacity need be no larger than about 190 milliliters, as a liquid poured therein immediately proceeds to flow out of the six outlets ports 14 configured for discharge thereof.

It will be understood that the number of outlet ports 14 can be arranged to be smaller, for example for use by small families. Similarly, the number of outlet ports can be arranged to be larger, for example for use in synagogues or at parties or public functions. Preferably the outlet ports 14 comprise small tubes which are sloped outwardly downwards, as shown.

The bowl 12 is supported by means of six support rods 16 above a lower baseplate 18. The six support rods 16 primarily serve a decorative function; to meet structural requirements one sturdy central pillar would suffice.

Six small drinking cups 20, only one of which is shown for purposes of illustration, are removably positioned on the baseplate 18 to respectively receive a beverage flowing out of the respective outlet ports 14. The cups 20 may be made either of glass or of the same material as the other distributor parts. The capacity of the cups 20 is in the range of 20 to 50 milliliters.

The distributor 10 may suitably be made out of silver-plated brass. Depending on the type of buyer targeted, other suitable materials of construction are sterling silver, gold, plastic, ceramic or another other material.

Where a low-cost distributor is required, this can be made from a chrome-plated plastic such as ABS or polypropylene.

Figure 2:
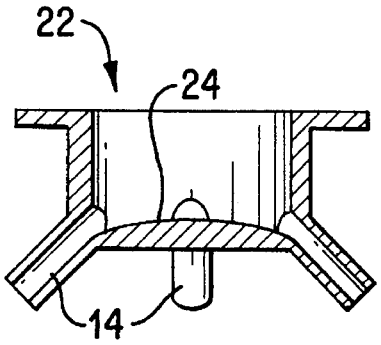
FIG. 2 is a detail sectional view of a second embodiment of a distributor bowl.

Referring now to FIG. 2, there is seen a second embodiment of as distributor bowl 22, which is provided with a lower inner surface 24 of convex shape. As can be seen, the surface 24 facilitates complete drainage of beverage poured therein when the distributor is in use, as liquid flow will be radially outwards to lead directly into the four outlet ports 14.

Figure 3:
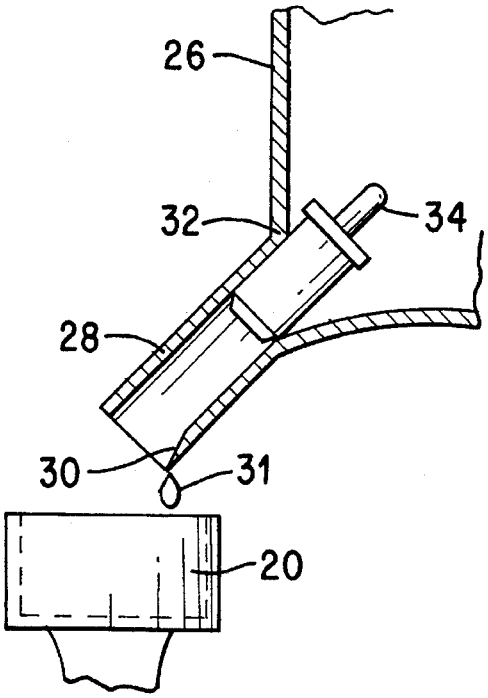
FIG. 3 is a detail sectional view of a distributor wherein outlet ports are provided with means to inhibit dripping.

FIG. 3 shows an enlarged detail of a distributor 26 wherein outlet ports 28 are at their lowest extremity provided with a sharp edge 30, a drop of liquid 31 suspended therefrom by surface tension will almost immediately fall therefrom by gravity into a small cup 20 thereunder.

The outlet ports 28 are at their upper extremity 32 provided with removable sealing means 34 shown in the form of a soft plastic plug 34. By inserting a plug 34 into one or more extremities 32, the user may selectively reduce the number of small drinking cups 20 receiving beverage, as may be required by the circumstances of use.

Figure 4:
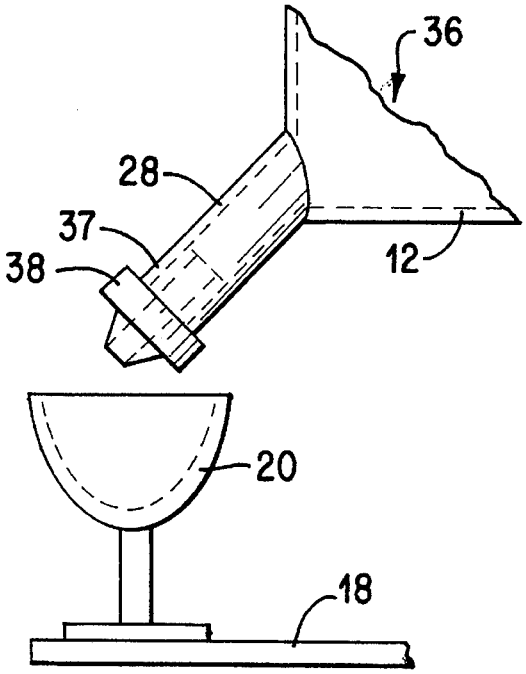
FIG. 4 is a detail front elevation of a distributor provided with removable restrictor means.

Seen in FIG. 4 is a detail of a distributor 36. The outlet ports 28 are at their lower extremity 37 provided with removable restrictor means 38 shown in the form of a soft hollow plastic plug 38. By inserting such a plug 38 into one or more outlet ports 28, the user may selectively reduce the quantity of beverage entering one or more of the small drinking cups 20. Thereby distribution will be unequal, as required for example to serve small children, and persons not fond of wine, who will thus be served a smaller quantity, while other cups 20 will receive approximately equal but larger shares of the remaining beverage poured into the bowl 12.

Figure 5:
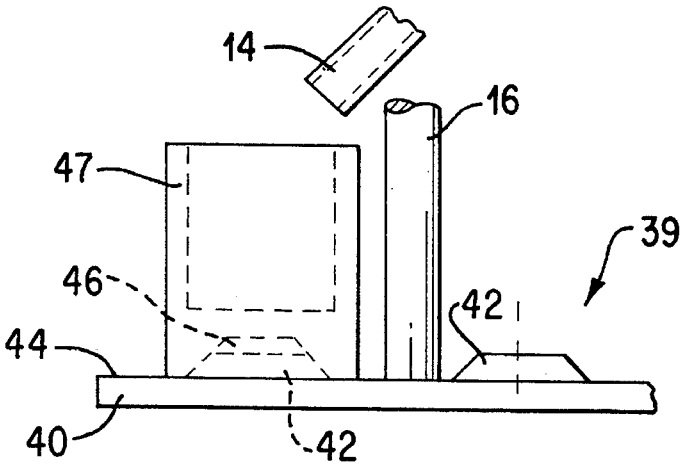
FIG. 5 is a detail, front elevational view of a distributor provided with removable restrictor means.

Referring now to FIG. 5, there is seen a detail of a distributor 29 provided with a baseplate 40. Locating means in the form of small projections 42 protrude above the upper surface 44 of the baseplate 40. A complementary recess 46 is provided in the base of each small drinking cup 47.

The projections 42 are so positioned that when the cups 47 are placed thereon, a beverage flowing out of the port 14 will enter the cup 47 without spillage.

Figure 6:
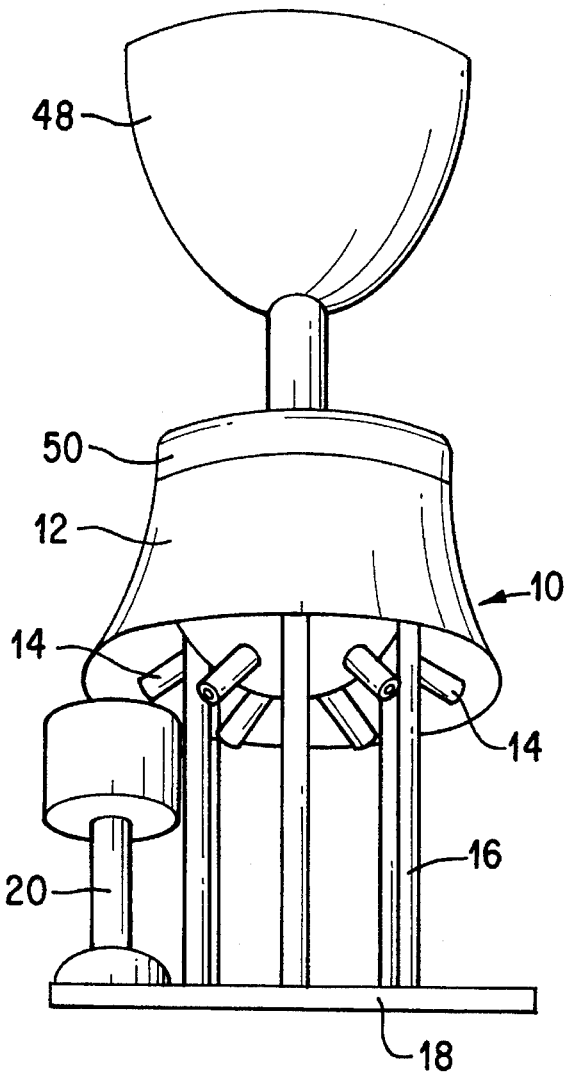
FIG. 6 is a perspective view again showing the distributor seen in FIG. 1, but here in combination with a goblet.

In a further embodiment of the distributor (not shown) the support rods 16 are positioned to act as locator columns for the small cups 20. FIG. 6 again shows the distributor 10, but here in combination with a goblet 48 of capacity at least twice that of each of the small drinking cups 20. Typically goblet capacity is in the range of 140 to 250 milliliters.

The goblet 48 is configured to stand centrally on the distributor bowl 12 when not in use.

Advantageously the goblet 48 is provided with a base 50 configured to act as a dust cover for the distributor bowl 12 when the goblet is placed centrally thereon.

Figure 7:
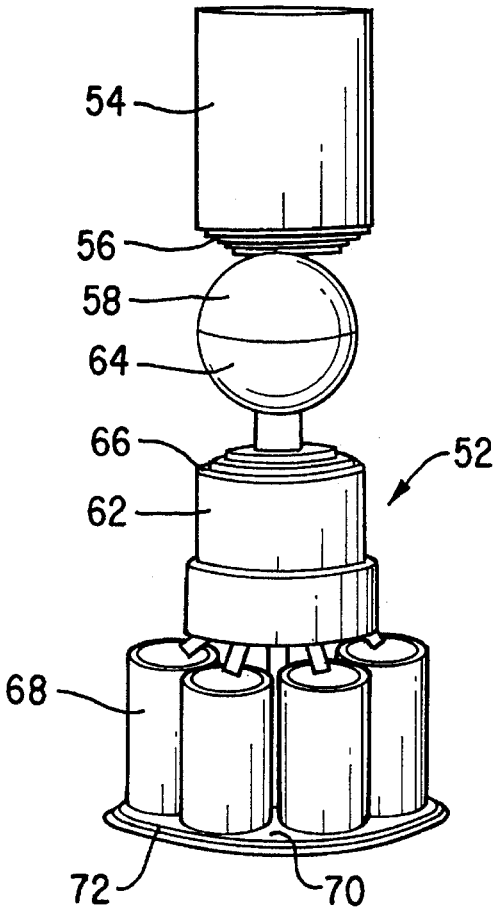
FIG. 7 is a perspective view of a distributor 52 provided with decorative features.

Seen in FIG. 7 is a distributor 52 further provided with decorative features whereby the complete distributor may serve for use as an ornament.

The goblet body 54 is provided with a plurality of disk-like steps 56. The base of the goblet is in the form of a hollow hemisphere 58. The open upper part of the distributor bowl 62 is in the form of a hollow hemisphere 64 of the same size as the hemisphere 58. The body of the bowl 62 is provided with a plurality of disk-like steps 66 complementary to the steps 56. The small cups 68 have a height/diameter ratio exceeding 1.5. Advantageously the cups 68 are made of sterling silver or are silver-plated. The baseplate 70 is also provided with disk-like steps 72.

A sample distributor constructed according to the figure was found to have aesthetic value as an ornament irrespective of its use as a functional item.

It will be evident to those skilled in the art that the invention is not limited to the details of the foregoing illustrative embodiments and that the present invention may be embodied in other specific forms without departing from the spirit or essential attributes thereof. The present embodiments are therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed is:

1. A distributor system for wine and other alcoholic beverages, comprising in combination:

an elevated distributor bowl for receiving a beverage poured therein, and provided with multiple outlet ports for discharge of said beverage;

a plurality of small drinking cups removably positioned beneath said distributor bowl, to respectively receive a beverage flowing out of said respective outlet ports; and a goblet of a capacity of at least twice that of each of said small drinking cups for holding and pouring the beverage into said distributor bowl, said goblet being configured to stand centrally on said distributor bowl when not in use, and being provided with a base configured to act as a dust cover for said distributor bowl when said goblet is placed centrally thereon.

2. A distributor as claimed in claim 1, wherein said base is provided with a rim having substantially the same configuration and dimensions as the rim of said distributor bowl.

3. A distributor as claimed in claim 1, wherein the lower inner face of said distributor bowl is convex to facilitate complete drainage of said beverage poured therein.

4. A distributor as claimed in claim 1, wherein said outlet ports are sloped outwardly downwards.

5. A distributor as claimed in claim 1, wherein said outlet ports are at their lowest extremity provided with a sharp edge to inhibit dripping.

6. A distributor as claimed in claim 1, wherein said outlet ports are at their upper extremity provided with removable sealing means whereby the user may selectively reduce the number of small drinking cups receiving said beverage.

7. A distributor as claimed in claim 1, wherein said outlet ports are provided with removable flow restrictor means whereby the user may selectively reduce the quantity of beverage entering one or more of said small drinking cups.

8. The distributor system for wine and other alcoholic beverages, according to claim 1, further comprising a baseplate and means for supporting said distributor bowl above said baseplate.

9. A distributor as claimed in claim 8, wherein said baseplate is provided with locating means to ensure correct positioning of said small drinking cups for the receipt of beverage from said outlet ports.

* * * * *